US005266076A

United States Patent [19]

Chitrangad et al.

[11] Patent Number: 5,266,076

[45] Date of Patent: Nov. 30, 1993

[54] FLUORINATED FINISHES FOR ARAMIDS

[75] Inventors: Chitrangad, Midlothian, Va.; Jose M. Rodriguez-Parada, Wilmington, Del.

[73] Assignee: E. I. du Pont de Nemours and Company, Wilmington, Del.

[21] Appl. No.: 825,482

[22] Filed: Jan. 24, 1992

[51] Int. Cl.[5] ..... D06M 10/06

[52] U.S. Cl. ..... 8/115.6; 8/DIG. 21

[58] Field of Search ..... 8/DIG. 21, 115.6

[56] References Cited

U.S. PATENT DOCUMENTS

| | | | |
|---|---|---|---|
| 3,147,065 | 9/1964 | Koshar et al. | 8/116.2 |
| 3,147,066 | 9/1964 | Brown et al. | 8/116.2 |
| 3,198,754 | 8/1965 | Ablbrecht et al. | 260/2 |
| 3,300,274 | 1/1967 | Pittman et al. | 8/127.6 |
| 3,564,004 | 2/1971 | Scherer et al. | 548/237 |
| 3,575,890 | 4/1971 | Litt et al. | 260/2 |
| 4,658,052 | 4/1987 | Ramloch et al. | 560/155 |
| 4,959,248 | 9/1990 | Oxenrider et al. | 8/115.6 |
| 5,025,052 | 6/1991 | Crater et al. | 524/104 |

FOREIGN PATENT DOCUMENTS

| | | |
|---|---|---|
| 889324 | 12/1971 | Canada . |
| 323541 | 7/1989 | European Pat. Off. . |

OTHER PUBLICATIONS

Research Disclosure, 30527 (Sep. 1989).
CA 109:11202m (1988).
CA 109:130746c (1988).
CA 103:216871c (1985).
CA 73:45495p (1970).
CA 74:112673f (1971).

*Primary Examiner*—Patrick P. Garvin
*Assistant Examiner*—E. D. Irzinski

[57] ABSTRACT

A method for modifying the surface properties of aramids by coating aramid fibers with certain fluorinated compounds containing polar nitrogen groups. Also disclosed are the fibers and fabrics produced by this process, and their use in ballistic applications.

29 Claims, No Drawings

FLUORINATED FINISHES FOR ARAMIDS

FIELD OF THE INVENTION

This invention concerns a method for modifying the surface properties of aramids by applying novel finishes. The surface treated aramids are especially useful in ballistic applications. Also disclosed are the coated aramid fibers themselves.

BACKGROUND OF THE INVENTION

Finishes are applied to fibers, including aramid fibers, for numerous reasons, such as avoiding fiber damage during processing, lessening friction with processing equipment so the equipment is not worn out quickly and the fiber is easily processed, modifying the feel ("hand") of the fiber, etc. For ballistic uses, aramid fibers with two conflicting properties are desired—low coefficient of friction with the process equipment, usually metal and/or ceramic, and a high fiber-fiber coefficient of friction, particularly when both are measured at higher speeds. The latter is believed to give fabric with improved ballistic properties. This sometimes necessitates the use of a first finish for processing, removal of the first finish, and then application of a second finish to provide high fiber-fiber friction. It is a goal of this invention to provide an aramid finish that gives fibers with relatively low fiber-metal (or ceramic) coefficients of friction, and relatively high fiber-fiber coefficients of friction.

U.S. Pat. Nos. 3,198,754 and 3,300,274 report that certain fluorinated aziridines and their polymers are useful for treating textiles. Aramids are not mentioned, and frictional properties are not discussed.

U.S. Pat. No. 3,575,890 reports that certain fluorinated polyoxazolines can be used to treat fabrics to impart oil and water repellency. Aramids and frictional properties are not mentioned.

U.S. Pat. Nos. 3,147,065 and 3,147,066 report that certain fluorinated compounds containing quaternary ammonium groups can be used to treat textiles to impart oil and water repellency. Aramids and frictional properties are not mentioned.

SUMMARY OF THE INVENTION

This invention concerns a process for treating aramids, comprising, contacting an aqueous solution of a compound of the formula $$F(CF_2)_nR^2NR_3^1 + X^-,$$

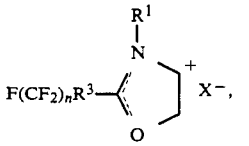

$$F(CF_2)_nR^3-C(=O)O-CH_2CH_2N(R^1)H_2^+X^-, \text{ or}$$

$$-(CH_2CH_2N)_y-(CH_2CH_2N)_z-$$
$$\quad\quad C=O \quad\quad\quad C=O$$
$$\quad\quad R^4 \quad\quad\quad R^3(CF_2)_nF$$

with an aramid fiber, and then drying said fiber, wherein:

each $R^1$ is independently hydrogen or alkyl containing 1, 2, 3, or 4 carbon atoms;
$R^2$ is alkylene;
$R^3$ is hydrocarbylene or a covalent bond;
$R^4$ is methyl or ethyl;
n is an integer of 4 to 20;
X is an anion;
y is 5 or more; and
z is 1 or more.

The invention also concerns an aramid fiber coated with a compound of the formula $$F(CF_2)_nR^2NR_3^1 + X^-,$$

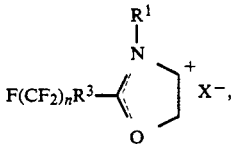

$$F(CF_2)_nR^3-C(=O)O-CH_2CH_2N(R^1)H_2^+X^-, \text{ or}$$

$$-(CH_2CH_2N)_y-(CH_2CH_2N)_z-$$
$$\quad\quad C=O \quad\quad\quad C=O$$
$$\quad\quad R^4 \quad\quad\quad R^3(CF_2)_nF$$

wherein:

each $R^1$ is independently hydrogen or alkyl containing 1, 2, 3, or 4 carbon atoms;
$R^2$ is alkylene;
$R^3$ is hydrocarbylene or a covalent bond;
$R^4$ is methyl or ethyl;
n is an integer of 4 to 20;
X is an anion;
y is 5 or more; and
z is one or more.

This invention also includes a fabric, comprising aramid fibers coated with a compound of the formula $$F(CF_2)_nR^2NR_3^1 + X^-,$$

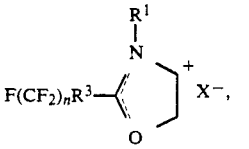

$$F(CF_2)_nR^3-C(=O)O-CH_2CH_2N(R^1)H_2^+X^-, \text{ or}$$

$$-(CH_2CH_2N)_y-(CH_2CH_2N)_z-$$
$$\quad\quad C=O \quad\quad\quad C=O$$
$$\quad\quad R^4 \quad\quad\quad R^3(CF_2)_nF$$

wherein:

each $R^1$ is independently hydrogen or alkyl containing 1, 2, 3, or 4 carbon atoms;
$R^2$ is alkylene;
$R^3$ is hydrocarbylene or a covalent bond;
$R^4$ is methyl or ethyl;
n is an integer of 4 to 20;
X is an anion;
y is 5 or more; and
z is one or more.

The fabric may be used to resist penetration by projectiles.

DETAILS OF THE INVENTION

The fibers on which the finish is applied in the instant invention are aramids. The term "aramids" here is given its common meaning, a polyamide derived from an aromatic diacid and an aromatic diamine, and optionally containing an aromatic aminoacid (the aramids are at least formally derived from such monomeric units—the actual polymers may be made by "reactive equivalents", such as acyl halides for the diacids). Preferred aramids are derived from terephthalic acid/p-phenylenediamine; 3,4'-oxydianiline/terephthalic acid; and isophthalic acid/m-phenylenediamine. A more preferred aramid is derived from terephthalic acid/p-phenylenediamine.

In all of the aramid finish compounds herein, $R^3$ may be hydrocarbylene. By hydrocarbylene is meant a group containing carbon and hydrogen, and having two free valencies. A preferred $R^2$ or $R^3$ is $-(CH_2)_p-$ wherein p is an integer of 1 to 20, and it is more preferred if p is 2 or 3. In all of these compounds it is preferred if n is 6 to 12, and more preferred if n is 8 or 10. In the block copolymer it is preferred if y is 5 to about 100, and z is 1 to about 25. In these finish compounds (where applicable) X is an anion such as trifluoromethanesulfonate, tosylate, chloride, hydrogen sulfate and acetate.

The finish

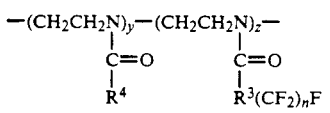

is a block copolymer containing blocks not containing fluorine, which have an average of y repeat units, and fluorocarbon containing block, which have an average of z monomer units. This polymer should be water soluble. The nonfluorine containing blocks tend to make the polymer soluble, and the fluorocarbon containing blocks tend to make the polymer water insoluble. Therefore, the solubility of the polymer can be adjusted by regulating the relative size of the nonfluorine containing and fluorocarbon blocks. The polymer also tends to be less water soluble as n increases.

Although the finish is effective at different loadings on the fiber surface, it is preferred if the fiber is coated with about 0.1 to about 1.0 weight percent of the finish, preferably about 0.3 to 0.7 weight percent.

The compounds used as finishes herein can be made by known methods. The oxazolines used herein (either directly or as intermediates) can be made by methods described in U.S. Pat. Nos. 3,293,245 and 3,681,329. Polymers can be made by the methods described in U.S. Pat. Nos. 3,198,754 and 3,575,890. A general scheme for the synthesis of all the compounds herein is given below. In addition, many of these reactions are illustrated in the Experiments herein.

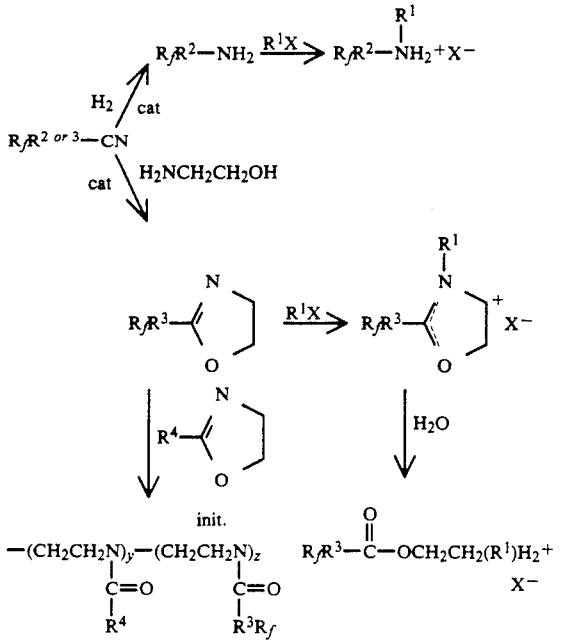

$R_f = F(CF_2)_n-$

It is believed (see Experiment 6) that oxazolinium salts

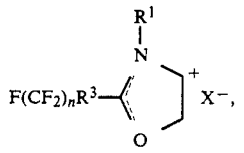

slowly hydrolyze to the corresponding ammonium salts, $F(CF_2)_nR^3-C(=O)O-CH_2CH_2N(R^1)H_2^+ X^-$, so that if one uses an aqueous solution of the oxazolinium salt as the aramid finish, with time the finish actually being applied may be a mixture of the oxazolinium and ammonium salts, and finally, essentially just the ammonium salt. Satisfactory results are obtained in any case.

The finishes are applied by contacting the aramid with an aqueous solution of the finish compound. By aqueous solution is meant a water "solution" that may also contain minor amounts of other solvents such as alcohols and water soluble ethers. The term solution also includes aqueous suspensions and emulsions. It is preferred if water is the only solvent or carrier present. The coating can be carried out at any convenient temperature between the freezing and boiling points of the water. However it is most convenient and preferred to carry out the coating at ambient temperature. Any convenient method for coating the aramid fibers may be used. For example, the fibers may simply be dipped into the aqueous solution or be roll coated with the solution. Excess solution may be removed by passing over rolls, or washing with water or another solvent, or other methods, and then the water is removed by drying. Drying conditions are not critical. Typical conditions may be just air drying, drying using heat, and drying under heat and vacuum. In general, the more concentrated the solution of the finish compound, the more finish that will be coated onto the fiber. A 1% by weight solution of the finish has been found convenient to use.

The aramid fibers coated with the novel finishes disclosed herein may be woven into fabrics. The fibers and fabrics are useful in applications where aramids are normally used, and are especially useful in ballistic applications, i.e., resisting penetration by projectiles, and for ropes.

In the following Examples, certain tests are performed. These were done as follows:

Coefficient of friction

Coefficients of friction were determined by the method described by T. Fort, Jr., and J. S. Olsen, Textile Research Journal, vol. 31, p. 1007-1011 (1961), which is hereby included by reference.

Extraction in methanol (MeOH) and $CCl_4$

A weighed amount of fiber is placed into a fritted funnel, swirled with 125 mL of $CCl_4$ for 1-2 min, and then the $CCl_4$ is drained and then gently blown from the funnel into a weighed aluminum cup. This is repeated twice more. The $CCl_4$ in the cup is then evaporated on a steam bath, the cup dried in an oven at 65° C., and then the cup is reweighed to determine the amount of finish extracted. The same sample of fiber is then extracted in the same way with MeOH. The MeOH may be put in the same or another cup. The additional amount of finish extracted by the MeOH is then determined in the same manner as for $CCl_4$.

In the Examples, the following materials are used:

Kevlar® 29 (Trademark of and available from E. I. du Pont de Nemours & Co., Wilmington, Del., USA-)—A 1500 denier yarn was used. The fiber is a an aramid derived from terephthalic acid/p-phenylenediamine.

Finish Y—A finish sometimes used on Kevlar® continuous filament, consisting mainly of fatty acid esters, and small amounts of a biocide and antioxidant.

Finish Z—A finish sometimes used on Kevlar® staple, consisting of a long chain alcohol phosphate ester salt.

EXAMPLES 1-3

Treatment of Kevlar® fibers with N-methyl-2-(n-per-fluorooctyl)ethyl-2-oxazolinium triflate (Example 1), N-methyl-2-(n-perfluorooctyl)ethyl-2-oxazolinium tosylate (Example 2), and a block copolymer of 2-methyl-2-oxazoline and 2-(n-perfluorooctyl)ethyl-2-oxazoline (Example 3)

In three separate 2 l round bottom flasks, equipped with reflux condensers and magnetic stirring, were placed 1 g each of the three finish compounds and 1 l of distilled water. The mixtures were slightly warmed and stirred to disperse the solids and 50 m (8.77 g) samples of finish-free 1500 denier Kevlar® fiber wound on a glass spool were placed in each of the flasks. The solutions were heated to reflux for 2 hr and left stirring overnight at room temperature. Then the fibers were taken out of the solutions, rinsed two times with distilled water, two times with methanol and dried under vacuum at 50° C.

The friction properties of these treated fibers are shown in Table I. The results show that these samples have higher fiber to fiber friction than the fibers treated with Finish Y, especially at high speeds. At the same time the fiber to metal friction is not that different from that of the standard finish fiber.

TABLE I

| | Speed → (cm/sec) | | | | | | | | | | |
|---|---|---|---|---|---|---|---|---|---|---|---|
| | F/F | | | | | F/M | | | | | |
| | .0016 | .32 | 32 | 64 | 128 | .0016 | .32 | 32 | 64 | 128 | Fh50 |
| Example | | | | | | | | | | | |
| 1 | .16 | .23 | .35 | .36 | .35 | .10 | .19 | .29 | .27 | .25 | .43 |
| 2 | .15 | .27 | .42 | .41 | .39 | .08 | .19 | .32 | .30 | .28 | .60 |
| 3 | .43 | .35 | .30 | .30 | .30 | .16 | .19 | .24 | .25 | .26 | .36 |
| Finish Y | .22 | .27 | .25 | .25 | .25 | .14 | .14 | .19 | .22 | .26 | .55 |

F/F friction at .0016-128 cm/sec with 30 g input tension and 180° wrap angle.
F/M friction on matted chrome roll at .0016-128 cm/sec with 30 g input tension and 180° wrap angle.
Fh50 hydrodynamic friction on smooth chrome at 50 yd/min with 30 g input tension and 170° wrap angle.

EXPERIMENT 1

N-Methyl-2-(n-perfluorooctyl)ethyl-2-oxazolinium triflate

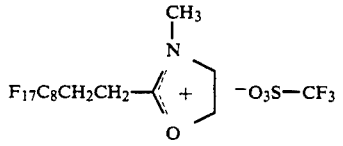

In a 250 ml round bottom flask equipped with dropping funnel, magnetic stirring and under argon atmosphere, were placed 10 g (61 mmol) of methyl trifluoromethanesulfonate and 100 ml of anhydrous ethyl ether. The solution was cooled to −20° C. and 10 g (19 mmol) of 2-(n-perfluorooctyl)ethyl-2-oxazoline were added dropwise over a 35 min period in order to maintain the temperature below −15° C. A precipitate was obtained immediately on addition of the oxazoline. The reaction mixture was allowed to warm up to room temperature and the solid product obtained was filtered off under argon, washed several times with ethyl ether and dried under vacuum. 12.44 g of a fine white powder was obtained, mp 110°-112° C. $^1H$ NMR (Acetone $d_6$, δ ppm): 2.83 (m, $—CH_2CF_2—$); 3.36 (t, $—CH_2CH_2CF_2—$); 3.59 (s, $CH_3N—$); 4.45 (t, $—CH_2N$); 5.17 (t, $—CH_2O—$). $^{19}F$ NMR ( Acetonitrile $d_3$, δ ppm): −78.1 (s, $CF_3SO_3—$); −80.2 (t, $CF_3—$); −113.8, −121.0, −121.9, −122.6 and −125.4 (m, $—(CF_2)_7—$). FTIR (KBr, cm−1): 1695 (C=N+); 1260 and 1035 ($CF_3SO_3—$).

EXPERIMENT 2

N-Methyl-2-(n-perfluorooctyl)ethyl-2-oxazolinium tosylate

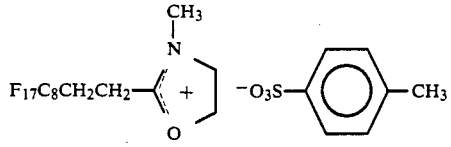

In a 200 ml round bottom flask equipped with condenser, magnetic stirring and under argon atmosphere, were charged 5 g (9.7 mmol) of 2-(n-perfluorooctyl)ethyl-2-oxazoline, 9 g (48 mmol) of methyl p-toluenesulfonate and 25 ml of acetonitrile. The flask was placed in an oil bath at 70° C. and left stirring overnight. Then the solution was cooled to room temperature and poured into ethyl ether. The precipitated product was filtered off under argon, washed with ether and dried under vacuum over $P_2O_5$. 3.85 g of a yellowish solid was obtained. $^1H$ NMR (Acetone $d_6$, δ ppm): 2.33 (s, $CH_3$—ϕ—); 2.80 (m, —$\underline{CH_2}CF_2$—); 3.35 (t, —$\underline{CH_2}CH_2CF_2$—); 3.55 (s, $CH_3N$—); 4.43 (t, —$CH_2\underline{N}$—); 5.15 (t, —$CH_2O$—); 7.15 and 7.65 (d, 4 aromatic protons).

EXPERIMENT 3

Block Copolymer of 2-methyl-2-oxazoline and 2-(n-perfluorooctyl)ethyl-2-oxazoline

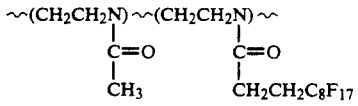

Into a 100 ml round bottom flask equipped with condenser, dropping funnel, magnetic stirring and under argon atmosphere, were charged 2 ml (23.4 mmol) of 2-methyl-2-oxazoline, 194.2 mg (0.78 mmol) of initiator N-methyl-2-methyl-2-oxazolinium triflate and 5 ml of 1,1,2-trichloroethane as solvent. The flask was placed in an oil bath at 100° C. and stirred for 6 hr. After this time, 2 g (3.9 mmol) of 2-(n-perfluorooctyl)ethyl-2-oxazoline dissolved in 20 ml of 1,1,2-trichloroethane were added slowly via dropping funnel. The reaction was continued at this temperature overnight. At the end of the set polymerization time, the reaction mixture was diluted with chloroform and poured into ethyl ether. The precipitated polymer was filtered and dried under vacuum at 50° C. 3.25 g of a yellowish powder were obtained. GPC (hexafluoroisopropanol, polyethyleneterephthalate standards): $M_n=10400$, $M_w=24100$.

EXAMPLE 4

Treatment of Kevlar® fibers with N-methyl-2-(n-perfluorooctyl)ethyl-2-oxazolinium triflate 500 m (~90 g) of finishfree 1500 denier Kevlar® fiber wound on a glass spool were placed in a solution of 6.28 g of N-Methyl-2-(n-perfluorooctyl)ethyl-2-oxazolinium triflate in 4 l of distilled water, and the solution was stirred for 65 hrs. At the end of this time the fibers were taken out, rinsed thoroughly with methanol and dried under vacuum at 50° C.

The results of friction tests are shown in Table II.

EXAMPLE 5

Treatment of Kevlar® fibers with N-methyl-2-(n-perfluorooctyl)ethyl-2-oxazolinium tosylate 500 m (~90 g) of finish-free 1500 denier Kevlar® fiber wound on a glass spool were placed in a solution of 7.5 g of N-Methyl-2-(n-perfluorooctyl)ethyl-2-oxazolinium tosylate in 4 l of distilled water, and the solution was stirred for 65 hrs. Finally the fibers were taken out, rinsed thoroughly with methanol and dried under vacuum at 50° C.

The friction tests results are shown in Table II.

EXAMPLE 6

Treatment of Kevlar® fibers with N-methyl-3-(n-perfluorooctyl) propylammonium tosylate 500 m (~90 g) of finish-free 1500 denier Kevlar® fiber wound on a glass spool were placed in a solution of 4.31 g of N-methyl-3-(n-perfluorooctyl) propylammonium tosylate in 4 l of distilled water, and the solution was stirred for 65 hrs. After this time the fibers were taken out, rinsed with methanol and dried under vacuum at 50° C.

The friction tests results are shown in Table II.

EXAMPLE 7

Treatment of Kevlar® fibers with 3-(n-perfluorohexyl) propylammonium chloride In a 4 l beaker were placed 2 l of distilled water and 2.5 ml (24 mmol) of 30% hydrochloric acid. 3-(n-perfluorohexyl) propylamine (10 g, 27 mmol) was added dropwise and the solution was left stirring overnight. The pH of the solution was adjusted to neutral by addition of a few drops of hydrochloric acid and the clear solution was diluted to 4 l with distilled water. 500 m of finish-free 1500 denier Kevlar® fiber wound on a glass spool were placed into the beaker and the solution was stirred at 80° C. for 8 hrs and at room temperature for 65 hrs more. The fibers were then taken out, rinsed with water, then with methanol, and finally dried under vacuum at 60° C.

The results of friction tests are shown in Table II.

As can be seen in Table II, all the finishes containing fluorinated chains increase fiber to fiber friction at higher speeds (128 cm/sec) compared to Finish Y while fiber to metal friction does not change much.

TABLE II

| | Speed → (cm/sec) | | | | | Extraction | | |
|---|---|---|---|---|---|---|---|---|
| | F/F | | F/M | | | | | % |
| | .0016 | 128 | .0016 | 128 | Fh100 | % in $CCl_4$ | %in MeOH | Total |
| Example | | | | | | | | |
| 4 | .18 | .44 | .06 | .25 | .55 | .11 | .04 | .15 |
| 5 | .14 | .42 | .04 | .25 | .60 | .09 | .09 | .18 |
| 6 | .14 | .40 | .04 | .31 | .58 | .02 | .20 | .22 |
| 7 | .18 | .36 | .04 | .38 | .39 | .07 | .26 | .33 |
| Finish Y | .23 | .26 | .04 | .25 | .55 | 1.08 | .10 | 1.18 |

F/F friction at .0016 & 128 cm/sec with 30 g input tension and 180° wrap angle.
F/M friction on smooth chrome at .0016 & 128 cm/sec with 30 g input tension and 180° wrap angle.
Fh100 hydrodynamic friction on smooth chrome at 100 yd/min with 30 g input tension and 170° wrap angle.

EXAMPLE 8

Treatment of Kevlar® fibers with 3-(n-perfluoroalkyl propylammonium tosylates Different amounts of 3-(n-perfluoroalkyl) propylammonium tosylates were applied onto 1500 denier Kevlar® fibers to determine the effect of the amount of finish on the friction properties. The results are shown in Table III.

As the amount of finish on yarn (% FOY) increases, the fiber to fiber friction at high speeds (128 cm/sec) and the hydrodyanmic friction (Fh125) increases while fiber to metal friction remains constant. This indicates that the friction properties can be controlled to some extent by the amount of finish applied.

TABLE III

| Sample | FOY % | Dep. | F/F .0016 | F/F 128 | F/M .0016 | F/M 128 | Fh125 |
|---|---|---|---|---|---|---|---|
| A | .27 | 0.1 | .22 | .27 | .05 | .28 | .51 |
| B | .43 | 0.1 | .18 | .34 | .07 | .28 | .56 |
| C | .57 | 0.1 | .19 | .35 | .08 | .27 | .61 |
| D | .71 | 0.1 | .16 | .33 | .06 | .26 | .68 |
| Finish Z | .32 | 0.1 | .22 | .37 | .06 | .23 | .48 |
| Finish Y | .90 | 10.8 | .27 | .27 | .08 | .27 | .55 |

% FOY Finish on Yarn (total $CCl_4$ + MeOH extraction)
Deposit mg deposit per Kg of yarn
F/F Fiber-to-fiber friction at .0016 & 128 cm/sec with 30 g input tension and 180° wrap angle.
F/M Fiber-to-metal friction at .0016 & 128 cm/sec with 30 g input tension and 180° wrap angle.
Fh125 Hydrodynamic friction on smooth chrome at 125 yd/min with 30 g input tension and 170° wrap angle.

EXPERIMENT 4

N-Methyl-3-(n-perfluorooctyl) propylammonium tosylate

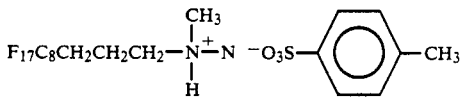

In a 250 ml round bottom flask equipped with dropping funnel, magnetic stirring and under argon atmosphere, were placed 5.5 g (11.8 mmol) of 3-(n-perfluorooctyl) propylamine and 50 ml of acetonitrile. The solution was cooled to −20° C. and 7 g (38 mmol) of methyl tosylate were added dropwise. A precipitate formed instantaneously. After the addition, the mixture was allowed to warm up to room temperature and the product was filtered, washed with acetonitrile and dried under vacuum. 5.69 g of a white powder was obtained. $^1H$ NMR ($CD_3OD$, δ ppm): 1.95 (m, $—NCH_2\underline{CH_2}CH_2CF_2—$); 2.30 (m, $—CH_2CF_2—$); 2.36 (s, CH3—ϕ—); 3.05 (t, $—CH_2N—$); 3.15 (s, $CH_3N—$); 7.22 and 7.70 (d, 4 aromatic protons).

EXPERIMENT 5

3-(n-Perfluoroalkyl) propylammonium tosylates

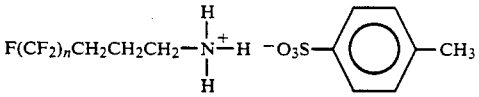

n = 4, 6, 8, 10, 12, 14 p-Toluenesulfonic acid monohydrate (62 g, 0.325 mol) was dissolved in 3.5 l of ethyl ether. 3-(n-Perfluoroalkyl) propylamines (100 g, 0.22 mol of 27.5% $C_6$, 61.6% $C_8$, 7.2% $C_{10}$ and 2.1% $C_{12}$) were added dropwise. A white precipitate was formed immediately on addition of the amines. The mixture was left stirring at room temperature overnight. Then the product was filtered off, extracted with ethyl ether in a soxhlet for 5 hrs and dried under vacuum. This procedure was repeated four times and a total of 436.3 g of product were obtained $^1H$ NMR (Dimethyl Sulfoxide $d_6$, δ ppm): 1.82 (m, $—NCH_2\underline{CH_2}CH_2CF_2—$); 2.28 (s, $CH_3$—ϕ—); 2.37 (m, $—CH_2\underline{CF_2}—$); 2.93 (m, $—CH_2N—$); 7.12 and 7.50 (d, 4 aromatic protons); 7.75 (b, $—NH_3^+$).

EXPERIMENT 6

Hydrolysis of N-Methyl-2-(n-perfluorooctyl)ethyl-2-oxazolinium triflate

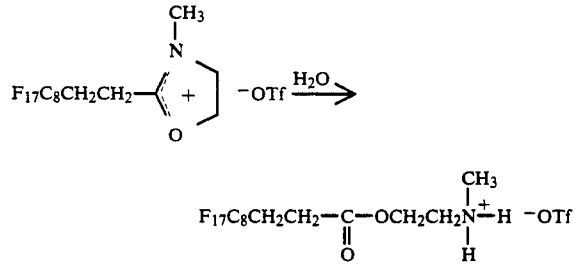

1 g of N-Methyl-2-(n-perfluorooctyl)ethyl-2-oxazolinium triflate was suspended in 30 ml of distilled water and stirred at room temperature for 24 hours. The water was evaporated in a rotary evaporator and the product was further dried in a vacuum oven. A white crystalline powder (0.79 g, mp 130°-132° C.) was collected. $^1H$ NMR (Acetone $d_6$, δ ppm): 2.61 (m, $—CH_2CF_2—$); 2.80 (t, $—\underline{CH_2}CH_2CF_2—$); 3.02 (s, $CH_3N—$); 3.65 (t, $—CH_2N$); 4.57 (t, $—CH_2O—$). $^{19}F$ NMR (Acetone $d_6$, δ ppm): −78.0 (s, $CF_3SO_3^-$); −80.5 (t, $CF_3$—); −114.0, −121.3, −122.2, −123.0 and −125.6 (m, $—(CF_2)_7—$).

FTIR (KBr, $cm^{-1}$): 1750 (C=O); 1235 and 1040 ($CF_3SO_3^-$).

Although preferred embodiments of the invention have been described hereinabove, it is to be understood that there is no intention to limit the invention to the precise constructions herein disclosed, and it is to be further understood that the right is reserved to all changes coming within the scope of the invention as defined by the appended claims.

What is claimed is:

1. A process for treating aramids, comprising, contacting an aqueous solution of a compound of the formula $$F(CF_2)_nR^2NR_3^1 + X^-,$$

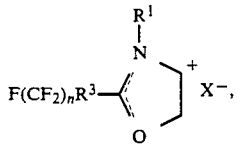

$$F(CF_2)_nR^3—C(=O)O—CH_2CH_2N(R^1)H_2^+X^-, \text{ or}$$

$$—(CH_2CH_2N)_y—(CH_2CH_2N)_z—$$
$$C=O \qquad C=O$$
$$R^4 \qquad R^3(CF_2)_nF$$

with an aramid fiber, and then drying said fiber, wherein:

each $R^1$ is independently hydrogen or alkyl containing 1, 2, 3, or 4 carbon atoms;

$R^2$ is alkylene;

$R^3$ is hydrocarbylene or a covalent bond;

$R^4$ is methyl or ethyl;

n is an integer of 4 to 20;

X is an anion;

y is 5 or more; and z is 1 or more.

2. The process as recited in claim 1 wherein said aramid fiber is a polymer derived from terephthalic acid/p-phenylenediamine; 3,4'-oxydianiline/terephthalic acid; or isophthalic acid/m-phenylenediamine.

3. The process as recited in claim 2 wherein said aramid is a polymer derived from terephthalic acid/p-phenylenediamine.

4. The process as recited in claim 1 or 2 wherein said $R^2$ or $R^3$ is $-(CH_2)_p-$, wherein p is an integer of 1 to 20.

5. The process as recited in claim 4 wherein said p is 2 or 3.

6. The process as recited in claim 1 or 2 wherein said n is 6 to 12.

7. The process as recited in claim 6 wherein said n is 8 or 10.

8. The process as recited in claim 1 or 2 wherein said fiber is coated with about 0.1 to about 1.0 weight percent of said compound.

9. The process as recited in claim 8 wherein said fiber is coated with about 0.3 to about 0.7 weight percent of said compound.

10. The product of the process of claim 1, 2 or 7.

11. The product of the process of claim 1 woven into a fabric.

12. An aramid fiber or fabric coated with a compound of the formula $$F(CF_2)_nR^2NR_3^1 + X^-,$$

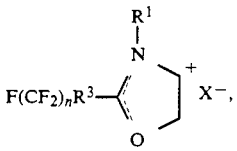

$$F(CF_2)_nR^3-C(=O)O-CH_2CH_2N(R^1)H_2{}^+X^-, \text{ or}$$

$$-(CH_2CH_2N)_y-(CH_2CH_2N)_z-$$
$$\quad\quad C=O \quad\quad\quad C=O$$
$$\quad\quad R^4 \quad\quad\quad R^3(CF_2)_nF$$

wherein each $R^1$ is independently hydrogen or alkyl containing 1, 2, 3, or 4 carbon atoms;

$R^2$ is alkylene;

$R^3$ is hydrocarbylene or a covalent bond;

$R^4$ is methyl or ethyl;

n is an integer of 4 to 20;

X is an anion;

y is 5 or more; and z is 1 or more.

13. The aramid fiber as recited in claim 12 wherein said aramid fiber is a polymer derived from terephthalic acid/p-phenylenediamine; 3,4'-oxydianiline/terephthalic acid; or isophthalic acid/m-phenylenediamine.

14. The aramid fiber as recited in claim 13 wherein said aramid is a polymer derived from terephthalic acid/p-phenylenediamine.

15. The aramid fiber as recited in claim 12 or 13 wherein said $R^2$ or $R^3$ is $-(CH_2)_p-$, wherein p is an integer of 1 to 20.

16. The aramid fiber as recited in claim 15 wherein said p is 2 or 3.

17. The aramid fiber as recited in claim 12 or 13 wherein said n is 6 to 12.

18. The aramid fiber as recited in claim 17 wherein said n is 8 or 10.

19. The aramid fiber as recited in claim 12 or 13 wherein said fiber is coated with about 0.1 to about 1.0 weight percent of said compound.

20. The aramid fiber as recited in claim 19 wherein said fiber is coated with about 0.3 to about 0.7 weight percent of said compound.

21. A fabric, comprising aramid fibers coated with a compound of the formula $$F(CF_2)_nR^2NR_3^1 + X^-,$$

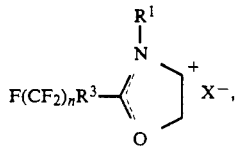

$$F(CF_2)_nR^3-C(=O)O-CH_2CH_2N(R^1)H_2{}^+X^-, \text{ or}$$

$$-(CH_2CH_2N)_y-(CH_2CH_2N)_z-$$
$$\quad\quad C=O \quad\quad\quad C=O$$
$$\quad\quad R^4 \quad\quad\quad R^3(CF_2)_nF$$

wherein each $R^1$ is independently hydrogen or alkyl containing 1, 2, 3, or 4 carbon atoms;

$R^2$ is alkylene;

$R^3$ is hydrocarbylene or a covalent bond;

$R^4$ is methyl or ethyl;

n is an integer of 4 to 20;

X is an anion;

y is 5 or more; and z is one or more.

22. The fabric as recited in claim 21 wherein said aramid fiber is a polymer derived from terephthalic acid/p-phenylenediamine; 3,4'-oxydianiline/terephthalic acid; or isophthalic acid/m-phenylenediamine.

23. The fabric as recited in claim 22 wherein said aramid is a polymer derived from terephthalic acid/p-phenylenediamine.

24. The fabric as recited in claim 21 or 22 wherein said $R^2$ or $R^3$ is $-(CH_2)_p-$, wherein p is an integer of 1 to 20.

25. The fabric as recited in claim 24 wherein said p is 2 or 3.

26. The fabric as recited in claim 21 or 22 wherein said n is 6 to 12.

27. The fabric as recited in claim 26 wherein said n is 8 or 10.

28. The fabric as recited in claim 21 or 22 wherein said fiber is coated with about 0.1 to about 1.0 weight percent of said compound.

29. The fabric as recited in claim 28 wherein said fiber is coated with about 0.3 to about 1.0 weight percent of said compound.

* * * * *